United States Patent [19]

Moritomo

[11] 4,019,288

[45] Apr. 26, 1977

[54] GRINDING METHOD AND APPARATUS

[75] Inventor: Sadao Moritomo, Ichikawa, Japan

[73] Assignee: Seiko Seiki Kabushiki Kaisha, Japan

[22] Filed: May 9, 1975

[21] Appl. No.: 576,183

[30] Foreign Application Priority Data

May 10, 1974 Japan ..... 49-52082
May 16, 1974 Japan ..... 49-54916

[52] U.S. Cl. ..... 51/327; 51/165.77; 51/165.93

[51] Int. Cl.[2] ..... B24B 49/00

[58] Field of Search ..... 51/165 R, 165.77, 165.92, 51/165.93, 134.5 R, 281 R, 327

[56] References Cited

UNITED STATES PATENTS 2,994,995 8/1961 Griffith ..... 51/134.5 R
3,798,846 3/1974 Smith ..... 51/134.5 R

FOREIGN PATENTS OR APPLICATIONS 1,275,204 5/1972 United Kingdom ..... 51/165.92

*Primary Examiner*—Harold D. Whitehead

*Attorney, Agent, or Firm*—Robert E. Burns; Emmanuel J. Lobato; Bruce L. Adams

[57] ABSTRACT

A method of feed grinding workpieces comprises moving a workpiece into pressure contact with a grinding wheel and rotationally driving the grinding wheel relative to the workpiece at a predetermined speed of rotation different than the resonant frequency of the grinding wheel spindle assembly to effect feed grinding of the workpiece. Completion of the feed grinding or spark-out is detected after which the rotational speed of the grinding wheel is lowered to another predetermined speed different than the resonant frequency of the grinding wheel spindle assembly when operating in the spark-out mode. The high speed rotation during feed grinding assures good grinding quality and the low speed rotation during spark-out assures good surface finishing. By rotating the grinding wheel spindle assembly at speeds other than its resonant frequencies, damage due to large vibrations of the assembly is avoided.

8 Claims, 9 Drawing Figures

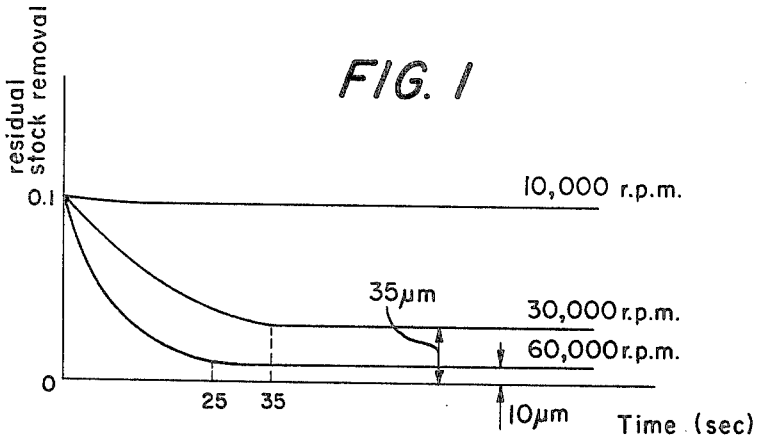
FIG. 1
residual stock removal
0.1
0
10,000 r.p.m.
35μm
30,000 r.p.m.
60,000 r.p.m.
25
35
10μm
Time (sec)
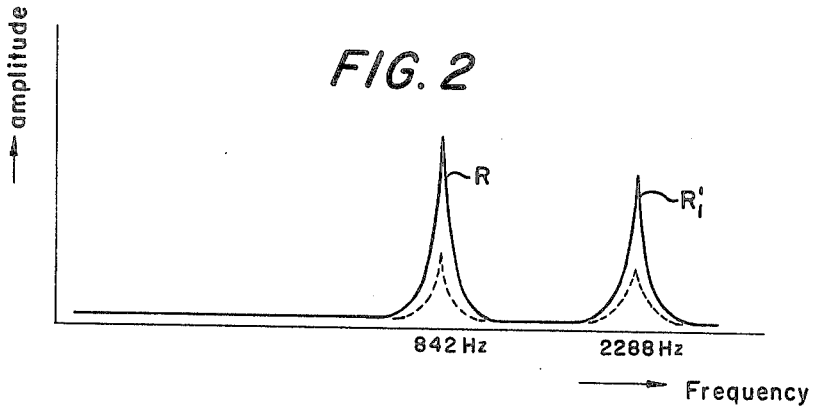
FIG. 2
amplitude
R
R'1
842 Hz
2288 Hz
Frequency
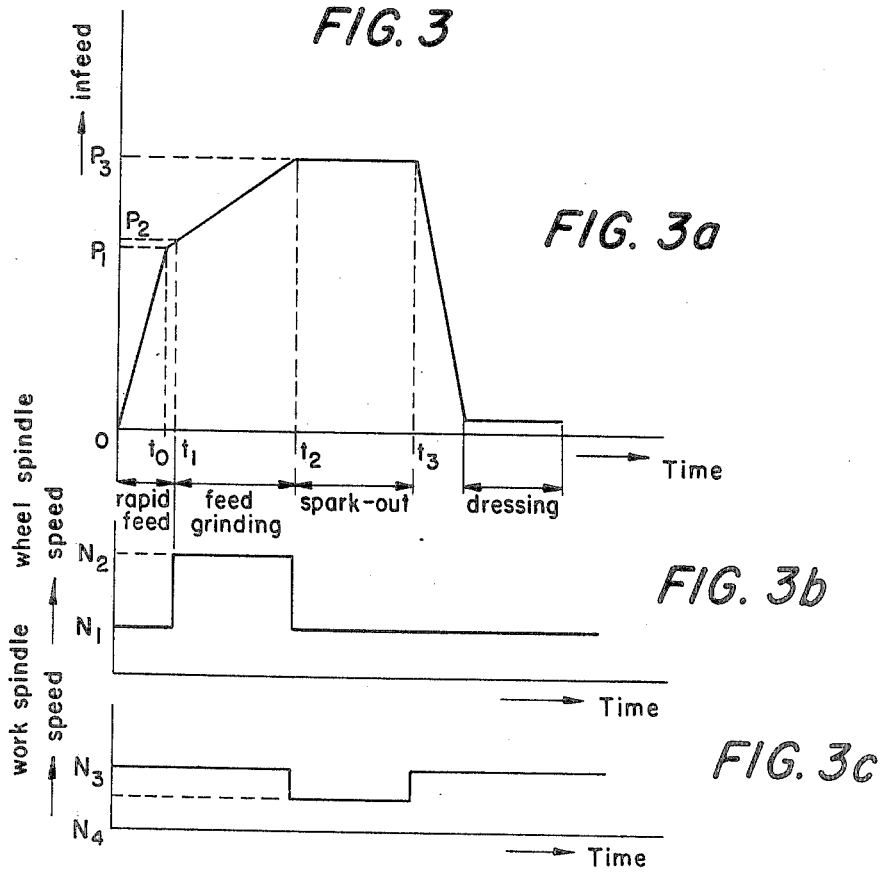
FIG. 3
infeed
P3
P2
P1
0
t0
t1
t2
t3
Time
rapid feed
feed grinding
spark-out
dressing
FIG. 3a
wheel spindle speed
N2
N1
Time
FIG. 3b
work spindle speed
N3
N4
Time
FIG. 3c

GRINDING METHOD AND APPARATUS

BACKGROUND OF THE INVENTION

The present invention relates to a grinding method wherein good grinding quality is attained with higher surface speed of the grinding wheels.

FIG. 1 is a graph showing grinding quality experimented in spark-out grinding by an internal grinding wheel which has a fine and easy-bending arbor, with the grinding wheel revolution speed being held as a varying parameter and the workpiece revolution speed constant. The graph illustrates, the initial depth of cut, that is, the amount of the grinding wheel surface penetration into the workpiece, at the initial state of the spark-out grinding, assuming no bending of the grinding wheel arbor but actually the amount of the grinding wheel arbor bending is 0.1 mm, which is called residual stock removal. In case of 10,000 r.p.m. of the wheel revolution speed, 0.1 mm is the residual stock removal remained through a lapse of time. In case of 30,000 r.p.m., the residual stock removal was reduced in an exponential curve and ws saturated, after 35 seconds, in 35 $\mu$m of the residual stock removal, depth of 65 $\mu$m being ground with the arbor bending force. In case of 60,000 r.p.m. saturated, after 25 seconds, in 10 $\mu$m of the residual stock removal.

This experiment clearly shows the fact that higher surface speed of the grinding wheel gives better grinding quality.

It has also been found out that grinding quality depends on the ratio of grinding wheel surface speed to workpiece surface speed, that is, the best grinding quality or sharpness in a grinding wheel surface speed is attained by selecting a workpiece surface speed which gives approximately ratio of 0.1 to the grinding wheel surface speed, other values of the workpiece surface speed, usually in far lower case, giving not so good grinding quality. Under good grinding quality, grinding process is able to correct such initial surface errors on the workpiece as taper and distortion in a section, and to prevent taper error mainly due to the grinding wheel arbor bending or sectional distortion error, which usually occurs, in case of grinding a workpiece having some grooves or notches on the grinding surface, in a manner that the groove allows the grinding wheel to more easily approach the workpiece when the groove passes the intersection of the grinding wheel and the workpiece, and the adjacent area of the workpiece surface to the groove is, thereby, ground a little depressed.

Other ratios of the workpiece surface speed and the grinding wheel speed of poor grinding quality are useful and sometimes actually used for good surface roughness such as mirror finishing.

It is also well known that, even if the ratio of grinding wheel surface speed to workpiece surface speed is best suited for grinding quality, only poor grinding quality would be attained if the revolution of the grinding wheel spindle or the work spindle, especially the former in internal grinding which has a fine arbor for grinding deep and small diameter hollows, corresponds to its resonant frequency. The spindle or its grinding wheel arbor should be rotated at a revolution speed sufficiently higher or lower than the resonant speed thereby avoiding the correspondence to this resonant frequency. A lower speed is safer as the spindle or its arbor does not pass through its resonant frequency during the running up and down.

From the results of our experiments, it is found that the resonant frequency of an internal grinding arbor which has a grinding wheel on the nose shifts according to the wheel contact condition with a workpiece or a dresser. As shown in FIG. 2, an internal grinding wheel arbor of 50 mm length and 6 mm diameter has a resonance-peak value R, at about 48,000 r.p.m. in its speed when it is free from grinding, being supported in a cantilever state, which is almost the same as in its dressing condition in which it is in slight contact with the dresser. When 200 gr. load is imposed on the grinding wheel in a radial direction, making its supporting condition a two point support, which is almost equivalent to its grinding state, the resonance-peak value is shifted from R, to R′, of about 120,000 r.p.m. in its speed.

In spark-out operation wherein the mean load of 20 gr. is observed, the resonance-peak-value alternately appears at 48,000 r.p.m. or 120,000 r.p.m. according to each-moment contact condition of the wheel to the work.

Thus, resonance frequencies of the grinding wheel shifts up and down in response to grinding step changes, the lowest resonance frequency appearing in dressing or spark-out operation.

Therefore, in the conventional grinding practice, the wheel revolution speed is usually limited lower than the resonance speed in dressing or spark-out operation, from which results poor grinding quality during the infeed grinding step as well as inferior grinding efficiency.

BRIEF SUMMARY OF THE INVENTION

It is the principal object of this invention to provide grinding method by which workpieces are ground very accurate with higher efficiency.

It is another object of the invention to provide grinding method suitable in particular for grinding small-sized and precision workpieces.

These and other objects are attained by grinding method in which a grinding wheel revolution speed is set for feed grinding at a proper high value apart from that corresponding to a first resonance frequency of the feedgrinding wheel spindle, this value of the revolution being stable and suitable to efficiently grind workpieces with high grinding quality, and when spark-out or finish grinding signal is detected, the speed is lowered to another value different from that corresponding to a second resonance frequency of the wheel spindle under spark-out or similar operation, this another value unsuitable for efficient and high quality grinding but suitable to improve workpiece surface roughness with some polishing function.

BRIEF DESCRIPTION OF THE DRAWINGS

FIG. 1 is a graph showing stock removing property on a workpiece ground by a grinding wheel during spark-out, FIG. 2 is a graph showing resonance frequencies of a grinding wheel spindle in various grinding steps, FIG. 3*a* a is a diagram showing an infeeding program between a grinding wheel and the workpiece, FIG. 3*b* is a diagram showing the grinding wheel revolution speed variation as a function of infeed of an infeed-table, according to the present invention, FIG. 3*c* is a diagram showing a work revolution speed variation as a function of infeed of the infeed-table, according to the present invention.

Figure 4:
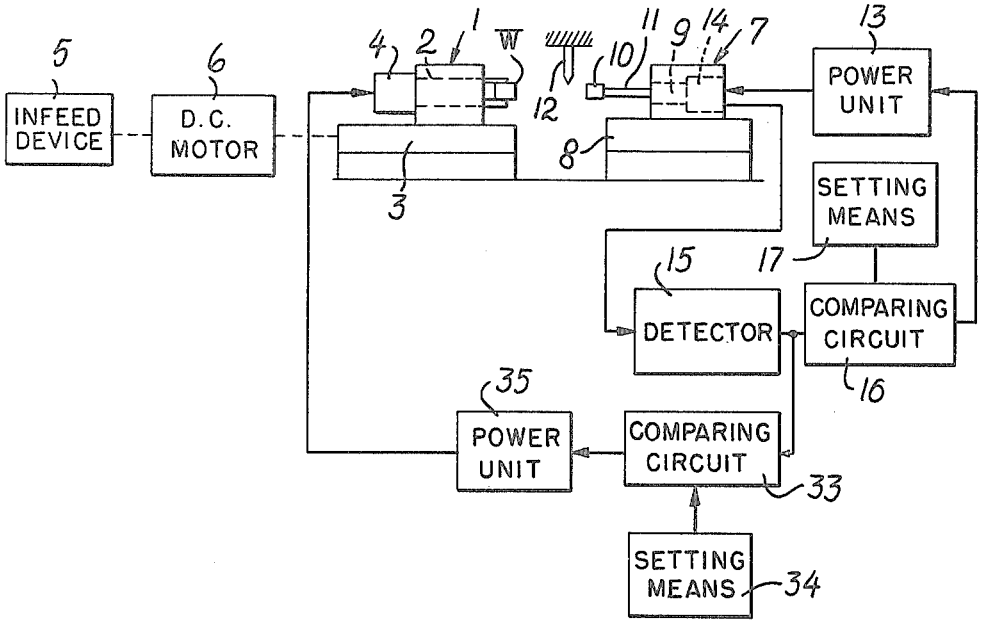
FIG. 4 is a block diagram showing an embodiment of the invention.
Figure 5:
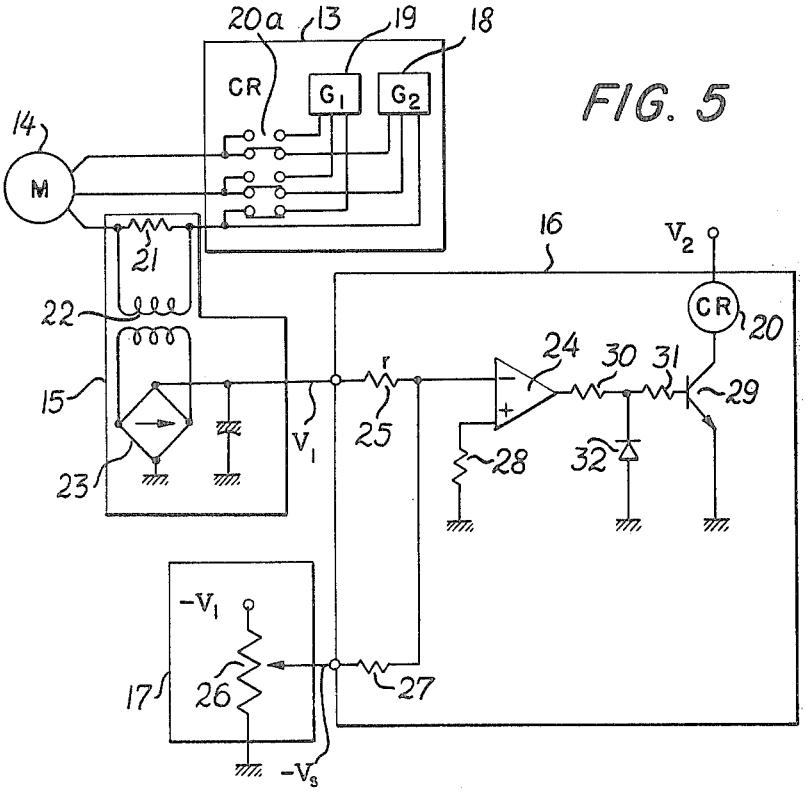
FIG. 5 is a schematic circuit diagram showing the control circuit of the embodiment.
Figure 6:
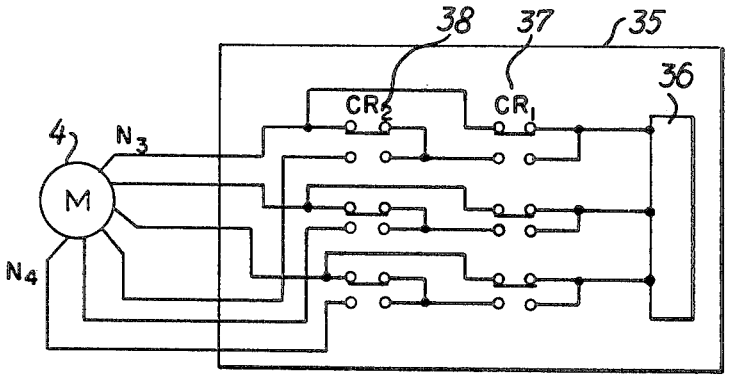
FIG. 6 is a detailed circuit diagram in a power unit for work spindle.

DETAILED DESCRIPTION OF THE PREFERRED EMBODIMENTS:

The above-mentioned objects and features of the invention will be more fully described in conjunction with FIGS. 3 to 5, in which internal grinding is controlled in a way that the grinding wheel speed and the workpiece speed are respectively changed in response to the grinding load.

FIG. 3*a* shows an infeeding program between the grinding wheel and the workpiece. The infeed movement from O to $P_1$ is a rapid apporoach of the workpiece to the wheel, and the movement from $P_1$ to $P_3$ represents the actual infeed grinding. At the position $P_3$ a spark-out operation is made from $t_2$ to $t_3$ oblong the time axis, after which a dressing operation is performed if required.

FIG. 3*b* shows the grinding wheel revolution speed variation, in which the speed is shifted to a higher level $N_2$ during the infeed grinding while it stays otherwise at a lower speed $N_1$ by means of a control system which will be described hereinafter.

FIG. 3*c* shows the workpiece revolution speed variation, in which the speed is shifted to a lower level $N_4$ during the spark-out operation while it stays otherwise at a higher speed $N_3$ by means of the control system.

FIG. 4 is a block diagram of one embodiment of control system, wherein reference numeral 1 is a work spindle-head having a work spindle 2 and mounted on an infeed table 3. The work spindle 2 is driven by a motor 4. The infeed table 3 is movable in a radial direction with respect to a workpiece W which is held on the work spindle 2, being connected mechanically to an infeed device 5. This infeed device 5 is driven by a D.C. motor 6, giving the table 3 infeeding movements. A grinding wheel spindle head 7 is mounted on a traverse table 8 and has thereon a wheel spindle 9. This wheel spindle has a grinding wheel 10 on the top end thereof mounted through an arbor 11 and the assemblage of rotary parts is referred to hereafter as the grinding wheel spindle assembly. The traverse table 8 is movable in the axial direction of the workpiece W so as to insert the grinding wheel 10 into the workpiece bore and to reciprocate it therein.

A diamond dresser 12 is spaced between the work spindle head 1 and the wheel spindle head 7, for dressing the wheel 10.

Reference numeral 13 is a power unit for selectively supplying electric power at high frequencies to a high frequency motor 14 of constant-torque type which is built in the wheel spindle head 7 to drive the wheel spindle 9 at a selected speed of rotation according to the frequency of the input signal.

Reference numeral 15 is a detector for detecting the load current of the motor 14. The current increases when actual feed grinding is performed that is, when the workpiece W being fed in its radial direction against the grinding wheel 10 (from $P_2$ to $P_3$ in FIG. 3a) and the detector 15 provides a detected signal in proportion to the load current and transmits the signal to comparing circuit 16 which compares the detected signal with a predetermined signal value set by wheel motor speed-changing value setting means 17, and accordingly the frequency of the power unit 13 in response to the detected signal.

This wheel spindle revolution speed control device is more particulary illustrated in FIG. 5, in which reference numerals are in correspondence with those in FIG. 4. The power unit 13 has two kinds of high frequency power generators 18 and 19 which are alternatively connected to the motor 14 through the switching contacts 20*a* of a relay 20. One of the lines connecting the motor 14 and the contacts 20*a* has a small-valued resistor 21 in series and a transformer 22 in parallel so that an alternating voltage in proportion to the load current of the wheel motor 14 is generated at the input terminals of the transformer 22.

A rectifier 23 is connected to the output of the transformer 22 to rectify the output signal into a D.C. signal which is transmitted to an operational amplifier 24 through a resistor 25 of a value $\gamma$.

The setting means 17 consists of a potentiometer 26, an end terminal of which is connected to a minus constant voltage source $-V_1$ a other end to the ground voltage level. The intermediate slide terminal of the potentiometer 26, which is used for setting a voltage of a value $Vs$ corresponding to that of the wheel motor speed-changing, is connected to the line between the resistor 25 and the operational amplifier 24 through a resistor 27 whose resistance value is the same as that of the resistor 25. The other input terminal of the operational amplifier 24 is connected to ground through a resistor 28. The output terminal of the amplifier 24 is connected to the base of a transister 29 through a series of resistors 30 and 31 between which is connected a diode 32. The other terminal of the diode 32 and the emitter of the transister 29 are connected ground so that the base of the transistor 29 is held at about 0 volt while the voltage $V_I$ generated at the output terminal of the detector 15 is greater than $|Vs|$. Under under these conditions, the relay 20 is de-energized and the generator 18 which generates electic power of higher frequency is connected to the motor 14, thereby rotating the wheel spindle 9 with the motor 14 at a higher revolutional speed $N_2$ than $N_1$-$N_1$ is the value of the revolutional speed during the rapid approach, spark-out operation and dressing operation in which $V_I$ is smaller than $|Vs|$ and the relay 20 is energized.

Reference numeral 33 in FIG. 4 is a second comparing circuit which compares the detected signal $V_I$ with another signal value set by work spindle motor speed-changing value setting means 34, and changes the arrangement of a second power unit 35 for the work spindle motor 4 so as to shift down the work spindle revolutional speed during spark-out operation. The second comparing circuit 33 and the second setting means 34 are similar to the comparing circuit 16 and the setting means 17. The second power unit 35 includes a power source, 36, switching contacts 37 of a second relay in the second comparing circuit 33 which are energized when the detected signal $V_I$ is smaller than the pre-set value of the setting means 34, and switching contacts 38 of another relay which are energized during actual feed grinding and spark-out by a suitable control circuit such as a timer circuit set on at time 0 in FIG. 3*a* or a position detecting circuit to detect an advanced location of the infeed table. The work spindle motor 4 is a pole-change type motor and the lines for effecting low speed revolution thereof are connected to the power source 36 when both of the switching contacts 37 and 38 are closed, otherwise the lines for effecting high speed revolution are connected to the power source 36. The relay of the switching contacts 38 becomes energized at the same time as the relay 20 and de-energized when a pre-set time for spark-out has elapsed simultaneously with return movement of the infeed table 3.

The operation of the above-described internal grinding is as follows: the speed of motor 14 is determined in such a manner that the wheel spindle 9 has a speed $N_1$ which is different from, and preferably lower than, that corresponding the to the resonance frequency (R, in FIG. 2) of the grinding wheel spindle assembly with its top end free from any contact, so as not to make it whirl nor resonate during rotation. The traverse table 8 is moved forward, inserting the grinding wheel 10 into the workpiece hollow. With this condition the infeed table 3 undergoes its infeed operation at rapid forward speed (O - $P_1$ in FIG. 3*a*). When the amount of in-feed reaches the position $P_1$ the infeed of the infeed table 3 is then changed to grinding feed operation by means of a micro-switch of the position detecting circuit. Then actual feed grinding starts to be effected at $t_1$. Load current of the motor 14 increases in response to the actual feed ginding. This load current increasing is detected by the detector 15 whereupon the wheel motor speed is changed from $N_1$ to $N_2$.

The grinding wheel shaft becomes in two-support state, one spindle end being supported by a bearing and the other spindle end being supported by pressure contact with the workpiece, in actual grinding operation, resonance $R_1$ vanishing and higher resonance $R'_1$ appearing, so that it becomes possible to increase the wheel speed to a value $N_2$ (110,000 r.p. m.) apart from and preferably lower than, that corresponding to the resonance frequency $R'_1$ of the grinding wheel spindle assembly to improve the grinding ability.

When, further, the grinding operation is performed at the infeed point $P_3$, feed grinding is finished and spark-out operation is started by detecting the workpiece diameter. At this time, a timer for spark-out is turned on and the infeeding of the infeed table 3 is stopped, causing the motor load current to decreasing. The detected signal of this decreasing load current is transmitted to both of the comparing circuits 16 and 33 and the wheel motor speed is lowered to $N_1$ and the work spindle motor speed is also lowered to $N_3$ to $N_4$ (see FIG. *c*)

Since the resonant frequencies $R_1$ and $R'_1$ appear in the spark-out operation, it is therefore necessary for securing stable rotation of the spindel and good finishing to lower the wheel spindle assembly speed. This is the reason for lowering the work spindle speed to attain excellent surface finishing such as mirror finishing, even though the lower speed yields rather poor grinding ability.

If so fine surface roughness of the workpieces is not required, it is not necessary to control the work spindle speed. In this case, the second setting means 34 and comparing circuit 33 can be omitted.

The timer for spark-out operates at a time point $t_3$ to return back the infeed table 3 and to switch off the switching contacts 38, changing the work spindle motor speed from $N_4$ to $N_3$.

Then, the traverse table 8 moves backward and reciprocates there for enabling the dressing operation.

During the dressing operation, resonance $R_1$ remains and the wheel motor speed is kept lower at $N_1$.

Figure 7:
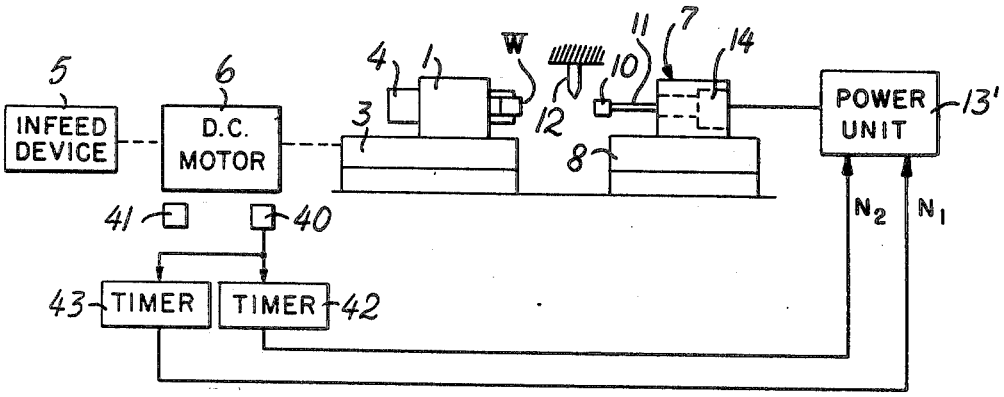
FIG. 7 is a block digram showing another embodiment according to the invention.

Referring to FIG. 7 which is a block diagram showing another embodiment accroding to the invention, reference numerals 40 and 41 are micro-switches operated by the infeed table movement. One micro-switch 40 detects a changing point $P_1$ from rapid approaching to feed grinding of the infeed table, the other micro-switch 41 detecting a changing point $P_3$ from feed grinding to spark-out step of the infeed table, as shown in FIG. 3*a*.

To the micro-switch 40 there are connected timers 42 and 43 in parallel. The time constant of the timer 42 is much smaller than that of the other timer 43.

Outputs of these timers 42 and 43 are transmitted to a power unit 13′ for the grinding wheel.

Other numerals in FIG. 7 are used in correspondance with those in FIG. 4 and denote the same parts.

During rapid infeed movement of the infeed table 3, it reaches a point $P_1$ where the micro-switch 40 is operated, changing the infeed speed to a speed suitable for feed grinding and operating the timers 42 and 43. The timer 42 is timed up at time $t_1$ to transmit a changing signal to the power unit 13′ after a sufficient time for starting actual feed grinding with disappearance of the resonance $R_1$ in FIG. 2. Therefore, the wheel motor speed is shifted from $N_1$ to $N_2$ at this time. The other timer 43 is timed up a little before the changing time $t_2$ from feed grinding to spark-out, again lowering the wheel motor speed to $N_1$.

It is to be noted that the detecting means or feed sensing menas for selecting the spindle speed changing points are not limited to current detectors or position detectors with timers in the above embodiments. A bending sensor to detect bending deflection of the grinding wheel arbor is another preferable type of feed sensing means. For this sensor, which is spaced close to the wheel arbor, a kind of non-contactable, eddy-current sensor is suitable. A differential transformer to detect infeed table position or a strain gauge to detect wheel head deflection may also be employed as the feed sensing means.

It is further to be noted that speed controllers to control the revolution speed of the grinding wheel spindle or of the work spindle are not limited to motor speed controllers in the above embodiments. Other speed changing devices such as clutches, change gears for mechanical transmission, pressure or flow controllers for fluid motors, or voltage controllers for D.C. motors may equally well be used as the speed controllers of the invention.

Finishing infeed of very low speed is replaceable for spark-out opearation in the invention.

What is claimed is:

1. A grinding method with revolution speed control of a grinding wheel, comprising the steps of: moving a grinding wheel into pressure contact with a workpiece; rotating the grinding wheel at a revolution speed effective for feed grinding and at a value different from that corresponding to a first resonance frequency of the wheel spindle as determined when the grinding wheel is in pressure contact with the workpiece to thereby feed-grind the workpiece; detecting spark-out or finish of the feed grinding and providing a corresponding signal; and then lowering the revolution speed in response to said signal to another value different from that corresponding to a second resonance frequency of the wheel spindle as determined when the grinding wheel is in spark-out operation, this resonance frequency being lower than the first, to thereby surface-grind the workpiece; whereby good grinding quality is attained in the feed grinding operation and good surface finishing in the spark-out operation.

2. A grinding method as claimed in claim 1, wherein the grinding wheel revolution speed is lower than that corresponding to said first resonance frequency of the wheel spindle.

3. A grinding method as claimed in claim 1, including maintaining the wheel revolution speed lower than said first-mentioned value during dressing of the grinding wheel.

4. A grinding method as claimed in claim 1, including maintaining the work revolution speed at a relatively high value which is selected such that the ratio of the workpiece surface speed to the grinding wheel surface speed gets to or approaches that at which best grinding ability is attained.

5. A grinding method as claimed in claim 4, including lowering the workpiece revolution speed during spark-out or finishing to a value at which said ratio is far smaller than the best condition value to effect mirror-finishing or polishing of the workpiece surface.

6. A method of feed grinding a workpiece on a grinding apparatus having a rotatable grinding wheel spindle assembly which includes a grinding wheel, comprising the steps of: moving a workpiece into pressure contact with the grinding wheel; rotationally driving the grinding wheel relative to the workpiece at a predetermined speed of rotation different than the resonant frequency of the grinding wheel spindle assembly as determined when it is in pressure contact with the workpiece so as to effect feed grinding of the workpiece; thereafter lowering the rotational speed of the grinding wheel to another predetermined speed of rotation different than the resonant frequency of the grinding wheel spindle assembly as determined when it is not in pressure contact with the workpiece; and then rotationally driving the grinding wheel relative to the workpiece at said another predetermined speed so as to effect surface finishing of the workpiece; whereby the high speed rotation of the grinding wheel spindle assembly during feed grinding assures good grinding quality and the low speed rotation during finishing assures good surface finishing while avoiding damage to the grinding wheel spindle assembly by ensuring that it does not rotate at one of its resonant frequencies.

7. A method according to claim 6; wherein said first-mentioned predetermined speed of rotation is lower than the resonant frequency of the grinding wheel spindle assembly as determined when it is in pressure contact with the workpiece thereby avoiding the necessity of rotating the grinding wheel spindle assembly through its resonant frequency in order to reach its feed grinding speed of rotation.

8. A method according to claim 6; including detecting completion of the feed grinding of the workpiece and providing a corresponding output signal; and wherein said step of lowering the rotational speed of the grinding wheel comprises lowering the rotational speed of the grinding wheel in response to said output signal.

* * * * *